United States Patent [19]

Kim et al.

[11] Patent Number: 4,996,460

[45] Date of Patent: Feb. 26, 1991

[54] DC TYPE PLASMA DISPLAY PANEL

[75] Inventors: Dae-il Kim; Woo-hyun Hwang, both of Suwon, Rep. of Korea

[73] Assignee: Samsung Electron Devices Ltd., Rep. of Korea

[21] Appl. No.: 398,439

[22] Filed: Aug. 25, 1989

[30] Foreign Application Priority Data

Jul. 28, 1989 [KR] Rep. of Korea ..... 89-10751

[51] Int. Cl.[5] ..... H01J 17/34

[52] U.S. Cl. ..... 313/586; 313/587

[58] Field of Search ..... 313/584, 585, 586, 587, 313/590, 506

[56] References Cited

U.S. PATENT DOCUMENTS 3,919,589 11/1975 Hanak ..... 313/506 X 4,562,434 12/1985 Anano ..... 340/775

FOREIGN PATENT DOCUMENTS 37634 3/1984 Japan ..... 313/582

*Primary Examiner*—Sandra L. O'Shea

*Attorney, Agent, or Firm*—Leydig, Voit & Mayer

[57] ABSTRACT

An improved plasma display panel is disclosed, the improvement comprising: a resistance layer stacked on the surface of a trigger electrode in such a manner that the surface of the resistance layer should be exposed to a discharge space filled with discharge gas, characterized in that the trigger electrode is unitized into a single piece so that the whole surface of the resistance layer should be matched with the whole surface of the trigger electrode. The device of the present invention is easy to manufacture because the dielectric which is complicated and has fastidious conditions is removed, and low cost metals as the material of the electrodes can be adopted, thus making it also possible to save the manufacturing cost.

2 Claims, 3 Drawing Sheets

DC TYPE PLASMA DISPLAY PANEL

FIELD OF THE INVENTION

The present invention relates to a plasma display panel, and particularly to a DC type plasma display panel which is easy to manufacture, low in the manufacturing cost, adequate in the response characteristics, and high in the contrast ratio.

BACKGROUND OF THE INVENTION

Among the conventional plasma display panel (to be called hereinafter "PDP"), there is a trigger discharge type PDP of Sony Corporation of Japan, which is disclosed in U.S. Pat. No. 4,562,434 and Japanese Laid-Open Patent Publication No. Sho 58-30038 which are in turn schematically and extractively illustrated in FIGS. 1 and 2 respectively. This trigger discharge type PDP comprises a front plate Fa, a rear plate Ba, a plurality of so-called X-Y matrix-shaped anodes Aa and cathodes Ka, and a plurality of separating walls Pa, Pa which are disposed between the respective anodes the anodes Aa so as for the anodes to be separated one another.

Especially, the cathodes Ka disposed in the Y direction are separated from the inner side of the rear plate Ba by a dielectric insulating layer Ia, while trigger electrodes (or auxiliary anode) disposed between the insulating layer Ia and the rear plate Ba. The trigger electrode Ta,Ta' can be either provided in a plurality of parallel strips like the cathodes Ka as shown in FIG. 1, or can be provided in a single piece having the same size as that of the whole rear plate Ba as shown in FIG. 2.

Such a PDP is operated in such a manner that a trigger discharge is generated before the occurrence of a main discharge for triggering the main discharge, and therefore, such a PDP has the advantages that the flickering at the initial stage of the main discharge is prevented, the response characteristics is markedly improved, and the realization of a high resolution image is made possible.

However, the above mentioned trigger discharge is generated through a medium of the dielectric insulating layer disposed between the trigger electrodes Ta and the cathodes Ka, and therefore, if the physical characteristics of the insulating layer is insufficient, then the product can not have the intended quality, thereby possibly leading to generation of large quantities of defective products. The reason is that the insulating layer not only serves as the a means for separating the cathodes Ka from the trigger electrodes Ta, but also as a means for depositing the wall charges which help to trigger the main discharge. In effect, a sternly precise dielectric constant is required for meeting the product characteristics and the design figures, while a high strength for withstanding against a voltage breakdown during the discharge is also required.

Further, in order to maintain high contrast ratio in said trigger discharge type PDP, the wall charge depositing region should be broadened so that satisfactory strength of trigger discharge can be obtained. For this purpose, the width of cathode should be formed as narrow as possible so as for the exposed width of dielectric layer to be formed relatively broadly. In this case, the contrast ratio may be raised, but brightness becomes relatively low because main discharge is lowered due to the decrease of the cathode width.

Meanwhile, in the manufacturing processes, a high precision work is also required, and particularly, the flatness of the trigger electrodes Ta should be kept above a predetermined level in order to prevent the concentration of electric charge on any particular region. Further, as the material of such trigger electrodes Ta, an organic metal paste having gold as the main ingredient is used, and therefore, the manufacturing cost of the product becomes very high.

SUMMARY OF THE INVENTION

Therefore it is an object of the present invention to provide a PDP which is easy to manufacture and low in the manufacturing cost.

It is another object of the present invention to provide a PDP in which the restriction of the trigger discharge current is possible, and which can achieve high brightness and high contrast ratio.

In achieving the above objects, the present invention provides a PDP having a front plate, a rear plate, a plurality of X-Y matrix-shaped cathodes and anodes, and trigger electrodes for triggering main discharges between the cathodes and the anodes, is constituted such that:

a resistance layer is coated on the surface of the trigger electrode so as for the surface to be exposed to the discharge space; and insulating layers are formed in the form of stripes on the above mentioned resistance layer with proper intervals between the stripes in order to dispose the cathodes on the surfaces of the insulating layers.

BRIEF DESCRIPTION OF THE DRAWINGS

The above objects and other advantages of the present invention will become more apparent by describing in detail the preferred embodiment of the present invention with reference to the attached drawings in which.

DESCRIPTION OF THE PREFERRED EMBODIMENT

Figure 1:
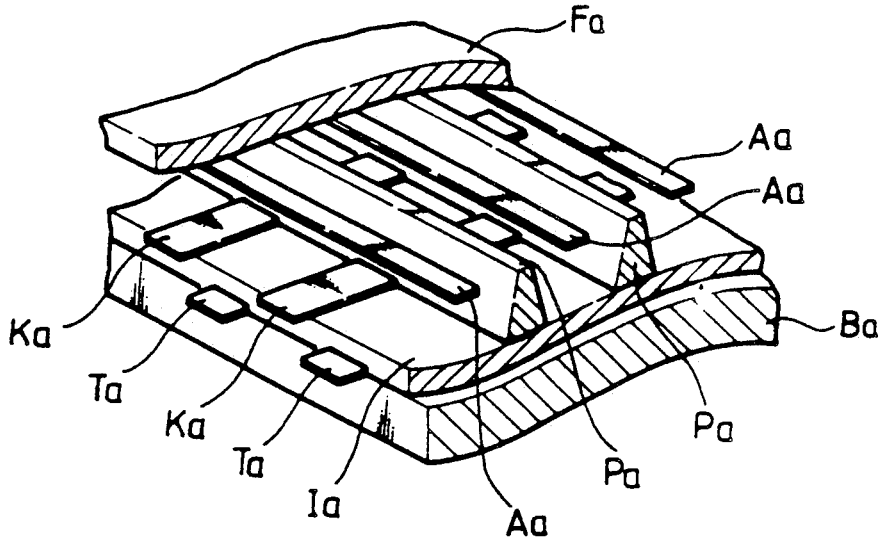
FIG. 1 (Prior Art)
FIGS. 1 and 2 are partially broken away perspective views of the conventional plasma display panels.
Figure 2:
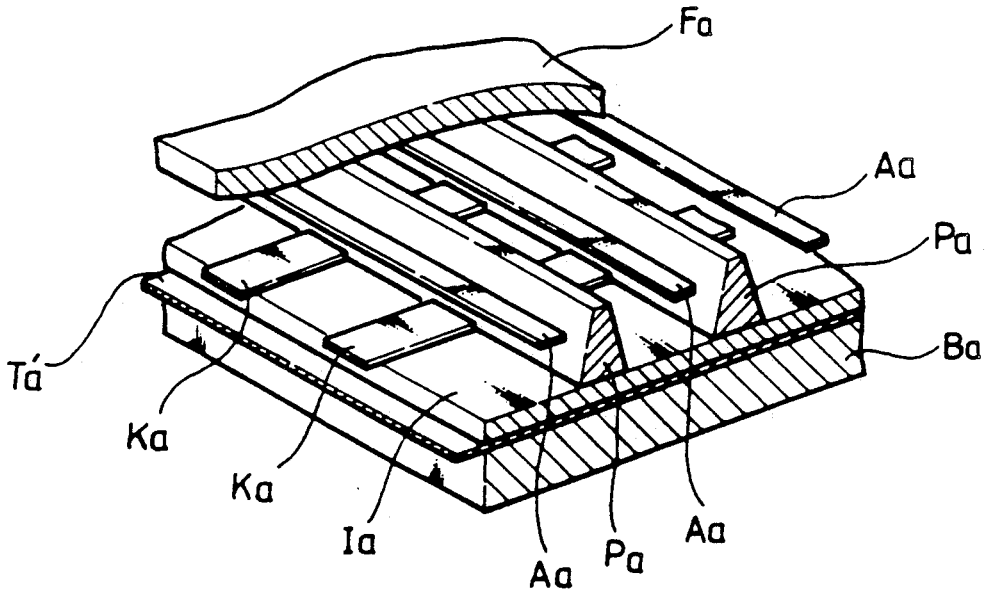
FIG. 2 (Prior Art)
Figure 3:
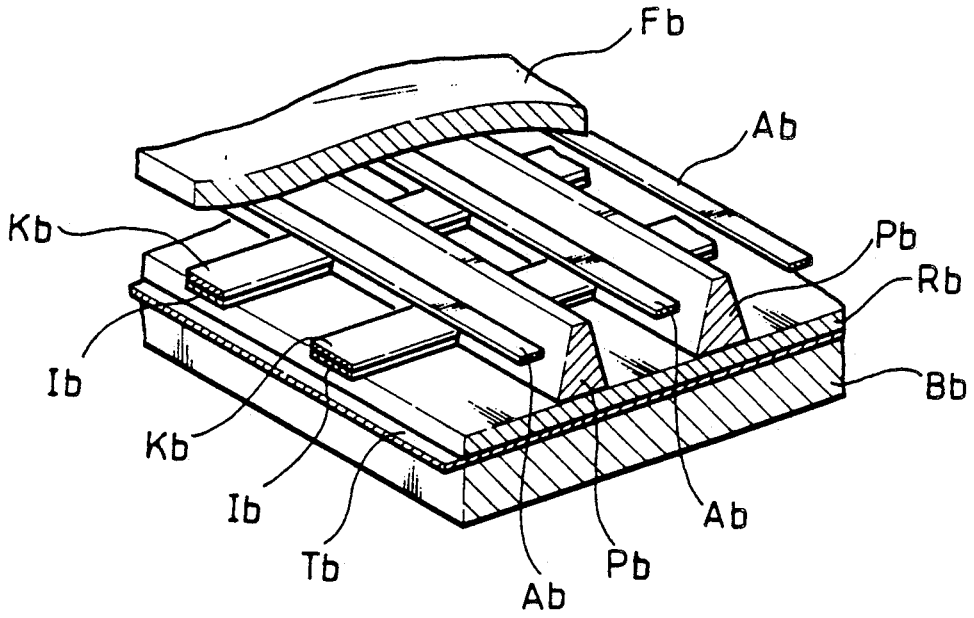
FIG. 3 is a partly broken away perspective view of a preferred embodiment of the device according to the present invention.

As shown in FIG. 3, the PDP according to the present invention is constituted such that: a plurality of anodes Ab are disposed on the inside of a front plate Fb; a rear plate Bb is installed fixedly and parallel to the front plate Fb through separating walls Pb which prevent cross talks by separating the anodes Ab from one another; a single trigger electrode Tb and a single resistance layer Rb are sequentially stacked on the surface of the rear plate Bb; and on the surface of the resistance layer Rb, a plurality of cathodes Kb are disposed in the form of stripes keeping a certain distance from the anodes Ab to form discharge spaces.

Figure 4:
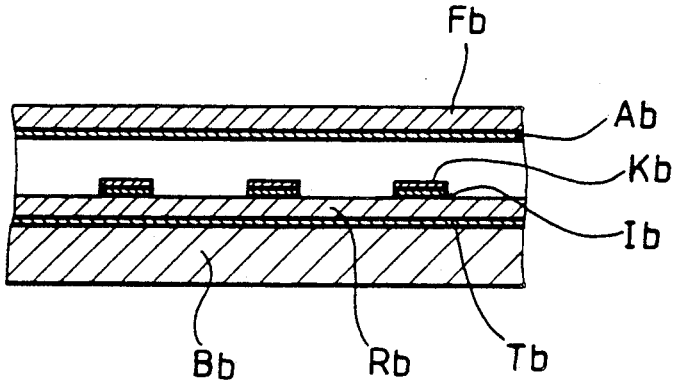
FIG. 4 is a sectional view of the PDP illustrated in FIG. 3.

As shown in FIG. 4 in effect, the trigger electrode Tb is exposed to the discharge space through the resistance layer Rb, and the cathodes Kb are disposed on the resistance layer Rb through an insulating layer Ib of a stripe form so that the cathodes Kb should be electrically insulated from the resistance layer Rb. The insulating layers Tb need not be electrified with wall charges, and therefore, they can be made of an ordinary insulating material regardless of dielectric constant.

The device of the present invention constituted as described above can be manufactured by the vacuum sputtering method, an etching method or a screen printing method, while, for the cathodes and anodes Kb,Ab the insulating layers Tb and the resistance layer Rb, the most desirable materials are nickel, ordinary non-conductive frit glass and $RuO_2$ respectively.

Figure 5:
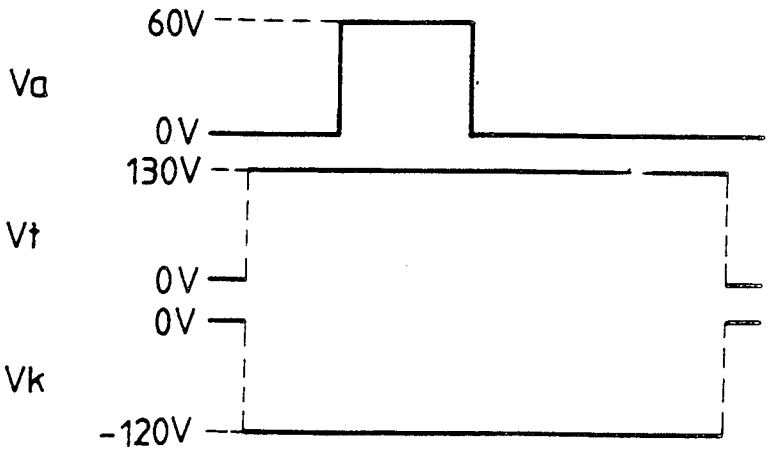
FIG. 5 illustrates the wave patterns of the driving voltages to be supplied to the PDP of FIG. 3.
Figure 6:
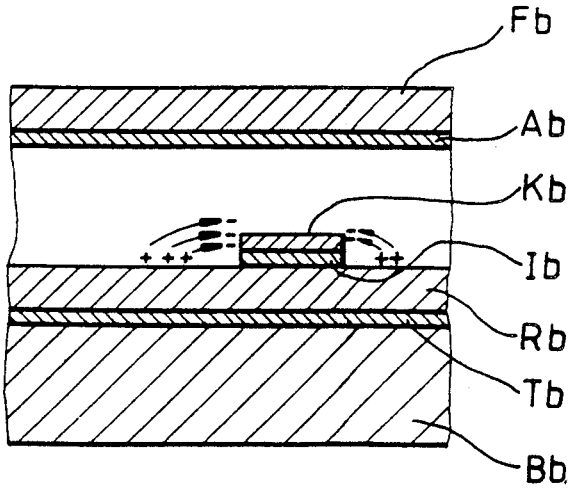
FIG. 6 is an enlarged sectional view of the PDP of FIG. 3 for illustrating the auxiliary discharge of PDP.

The PDP of the present invention is driven, for example, by applying a pulse type voltage as shown in FIG. 5. If a positive trigger voltage Vt of +130 volts is always supplied to the trigger electrode in accordance with the scanning signals, and the cathode voltage Vk is shifted to a low (−120 volt) state in accordance with the vertical and horizontal synchronizing signals, then as shown in FIG. 6, a space glow discharge (trigger discharge) occurs between the trigger electrode Tb and the cathodes Kb. Then, if the anode voltage Va is shifted to a high (+60 volts) state, then a main discharge is triggered and promoted between the cathodes Kb and the anodes Ab due to the space charges of high concentration accumulated in the discharge space.

In the PDP of the present invention, the trigger discharge between the trigger electrode and the cathodes occurs in the discharge space in which halogen gas is filled, and therefore, as long as there is continuously maintained a voltage difference between the cathodes and the trigger electrode, the discharge will be continuously generated. That is, due to the synchronizing pulses which continuously comply with the horizontal and vertical synchronizing signals, successive discharges will occur, and thereby assisting the main discharges. Further, the discharges occur through the medium of the interposed resistance layer, and therefore, the discharge current during the trigger discharges is restricted so as for the luminance of the discharge glow to be reduced, with the result that the number of the components for example, resistors in the peripheral equipment is reduced compared with the conventional PDP in which separate resistors are installed.

In the PDP according to the present invention which is driven by supplying pulse type voltages as described above since dielectric layer is not required as in the conventional AC type PDP, high contrast ratio as well as high brightness is achieved compared with the conventional PDP. This is due to the fact that the trigger electrode can be formed with narrower exposed width and cathode can be formed with wider width to trigger the main discharge by means of the space charge due to the trigger discharge.

As described above, the device of the present invention has the advantage that it can be easily manufactured, because the dielectric which is complicated and has fastidious conditions is removed, and low cost metals as the material of electrodes can be adopted. Therefore, the manufacturing cost can also be saved for the reason set forth.

What is claimed is:

1. A plasma display panel comprising:

a front plate and a rear plate spaced to provide a discharge space, a plurality of cathodes and anodes arranged between said plates in an X-Y matrix, said anodes being in proximity to said front plate and said cathodes being in proximity to said rear plate, a trigger electrode which triggers main discharges between said cathodes and said anodes, said trigger electrode being between said cathodes and said rear plate, a resistance layer on a surface of said trigger electrode and positioned such that a surface of said resistance layer is exposed to the discharge space, and an insulation layer between said resistance layer and said cathodes.

2. The plasma display panel as claimed in claim 1, wherein said trigger electrode is a single piece and an entire surface of said resistance layer is adjacent an entire surface of said trigger electrode.

* * * * *